United States Patent [19]

Burns

[11] Patent Number: 4,579,511

[45] Date of Patent: Apr. 1, 1986

[54] AIR LIFT PUMP SYSTEM

[76] Inventor: Richard L. Burns, 408 San Jacinto, Rockdale, Tex. 76567

[21] Appl. No.: 741,113

[22] Filed: Jun. 4, 1985

[51] Int. Cl.[4] ..... F04F 1/18

[52] U.S. Cl. ..... 417/109

[58] Field of Search ..... 417/108, 109, 118, 137, 417/138

[56] References Cited

U.S. PATENT DOCUMENTS

| | | | |
|---|---|---|---|
| 987,475 | 3/1911 | Martin | 417/118 |
| 1,279,580 | 9/1918 | Peters | 417/118 |
| 2,786,602 | 3/1957 | Kamm | 417/108 |
| 3,930,754 | 1/1976 | Mogg et al. | 417/108 |

*Primary Examiner*—Richard E. Gluck

[57] ABSTRACT

Disclosed is a pumping system utilizing pressurized air injected into a lift assembly submerged in oil fluids for lifting of these oil fluids from a well. The system includes a volume expansion chamber with a self-cleaning check valving assembly. The lift assembly being suspended in the well by highly efficient, corrosion resistant, production and air supply tubing. Pressurized lift air is supplied to the lift assembly through a photovoltaic solar powered programmable control device by a pressure regulated air compressor. The entire lift system being constructed of such light weight chemically resistant materials as to allow hand installation and retrieval thereby greatly improving low production well economics. The system process efficiency is such that one air supply compressor will provide lifting capacity for multiple producing wells also providing another advantage in shallow oil well economics.

13 Claims, 6 Drawing Figures

AIR LIFT PUMP SYSTEM

BACKGROUND OF THE INVENTION

1. Field of the Invention

The present invention relates to a fluid moving system whereby the movement of such fluid is from the producing formation elevation of a shallow well to the earth's surface. The more specific intended application of the herein described invention encompasses a downhole air lift pumping assembly utilizing pressurized air supplied by an air compressor through a photo-voltaic programmable control system which supplies artificial lift air to oil from its sub-surface formation through production tubing suspended in a well bore and casing to the earth's surface and storage.

2. Background Art

Many shallow oil wells do not initially contain sufficient reservoir pressure necessary to provide natural lift of the oil and any associated fluids from the sub-surface producing formation level to the earth's surface. When this condition exists, it becomes necessary to utilize equipment and methods known as "artificial lift" to accomplish movement of the oil fluids from the well to the surface.

The type of pumping method selected for this artificial lift is determined by differing factors such as: production rate, well depth, well cleanliness, oil viscosity, economics of production, and others.

The most common lift method utilized today is the reciprocating sucker-rod and jack technique which incorporates a piston/ball mechanical pump located in production tubing at the producing formation level.

Other types of lift systems sometimes used are the submersible and screw type pump located downhole in the well bore; gas lift valves on production tubing; and the bailer or wick type pump.

Each of these systems has its specific technique of employing lift; however all have common disadvantages in operation and well economics. Each system, excluding gas lift valves, produces friction losses and internal wear. Gas lift valves on the other hand, require higher reservoir pressure for proper operation which most shallow wells commonly lack. All of the above systems require high capital expenses upon initial installation due in part to the system design and mechanical equipment required for operation. They historically also require large amounts of professional workover maintenance expense simply to keep in operation.

Giving consideration to the characteristics associated with these various pumping systems, it becomes unfeasible to drill, complete, and then produce many low volume shallow oil wells primarily due to the previously mentioned economic expenditures of equipping such a well and then the associated excessive mechanical expenses required to maintain it in operation.

In view of this, there would be a significant advantage to shallow oil operations if an efficient, economical, easily installed and maintenance reduced lift system could be provided.

BRIEF SUMMARY OF THE INVENTION

The preferred form of the present invention consists of a dual-valved lift assembly with volume expansion chamber utilizing injected pressurized supply air to lift oil from the producing formation level through a highly efficient production line to the well surface of storage.

The lifting of the oil is accomplished by injecting pressurized air supplied from a surface mounted pressure regulated air compressor through a programmable photovoltaic control device. The control device is connected to an air lift supply line extending from the control device at the well surface to the lift assembly downhole. Upon operation of the control device air is injected into the lift assembly through the inlet nozzle. The pressurized air then expands, decreasing the specific gravity of the accumulated volume of oil in the volume expansion chamber. Through the simultaneous action of kinetic air expansion, decreased specific gravity, and hydrostatic well fluid pressure, an efficient lift of oil is made from the downhole lift assembly to the well surface and storage.

An important feature is the use of a photovoltaic timing circuit and pulse valve so programmed to match the fluid inflow rate of an individual well. After a predetermined hydrostatic recharge time of the air lift assembly has elapsed, another lift cycle is initiated. This action then continues as the normal operating process of the present invention. The pressure regulated air compressor constantly maintains the correct operating pressure and supply air. The only adjustments necessary may be the re-programming of the control device to match any change in an individual well's production rate.

It is a primary object of the present invention to provide a new and improved artificial lift system for shallow oil wells. This present invention provides a high degree of reliabilty in operation by employing in design a minimal number of moving parts in the downhole lift assembly thereby resulting in decreased maintenance expense.

It is another object of this invention to utilize the kinetic expansion of pressurized air thereby decreasing the specific gravity of the contained oil fluids while acting in conjunction with the hydrostatic pressure head of the well fluids. This action provides a highly efficient air lift oil fluid pump system.

It is another object of this invention to provide a single nozzle injection point into a closed loop lift system and by so doing eliminates any unnecessary pressurizing of the oil producing formation which may inhibit the natural inflow of oil fluids to the well bore.

It is another object of this invention to provide an injection nozzle so positioned as to utilize the injected pressurized air as an internal cleaning medium of the assembly lift check valve making this system highly conducive for use in well with a high contaminant level, particularly formation sand.

It is another object of this invention to provide a downhole volume expansion chamber used to decrease oil fluids specific gravity and increase lift efficiency.

It is another object of this invention to provide a new and improved, lightweight, high pressure lift production and air supply tubing which as utilized will decrease installation and workover expenses.

It is another object of this invention to provide a new and improved lift production tubing which incorporates materials with characteristics that exhibit maximum flow characteristics and line efficiency while maintaining minimal internal contaminant buildup.

It is another object of this invention to provide a photovoltaic solar powered control system that in its self-contained arrangement minimizes installation time and expense.

It is another object of this invention to provide a programmable control system capable of being programmed to match well production rates and best operating efficiency.

It is another object of this invention to provide a pulse operated control valve which requires minimal energy consumption during operation and through the additional low flow characteristics of the valve minimizes potential emulsions which frequently form with other types of artificial lift systems.

It is another object of this invention to provide a highly efficient lift system which utilizes a low volume of injected air thereby reducing operating costs.

It is another object of this invention to provide a pressure monitoring device which will continuously monitor lift efficiency, well downhole conditions, and well fluid levels.

It is another object of this invention to provide a surface mounted, pressure regulated air compressor of adequate size which will act as a common pressurized air supply source for multiple wells and thereby greatly reducing the capital cost of equipping each producing well.

Other objects, features, and advantages of this invention will become apparent from the following detailed description of the specifications, drawings, and claims.

DESCRIPTION OF THE ILLUSTRATED EMBODIMENTS

Figure 1:
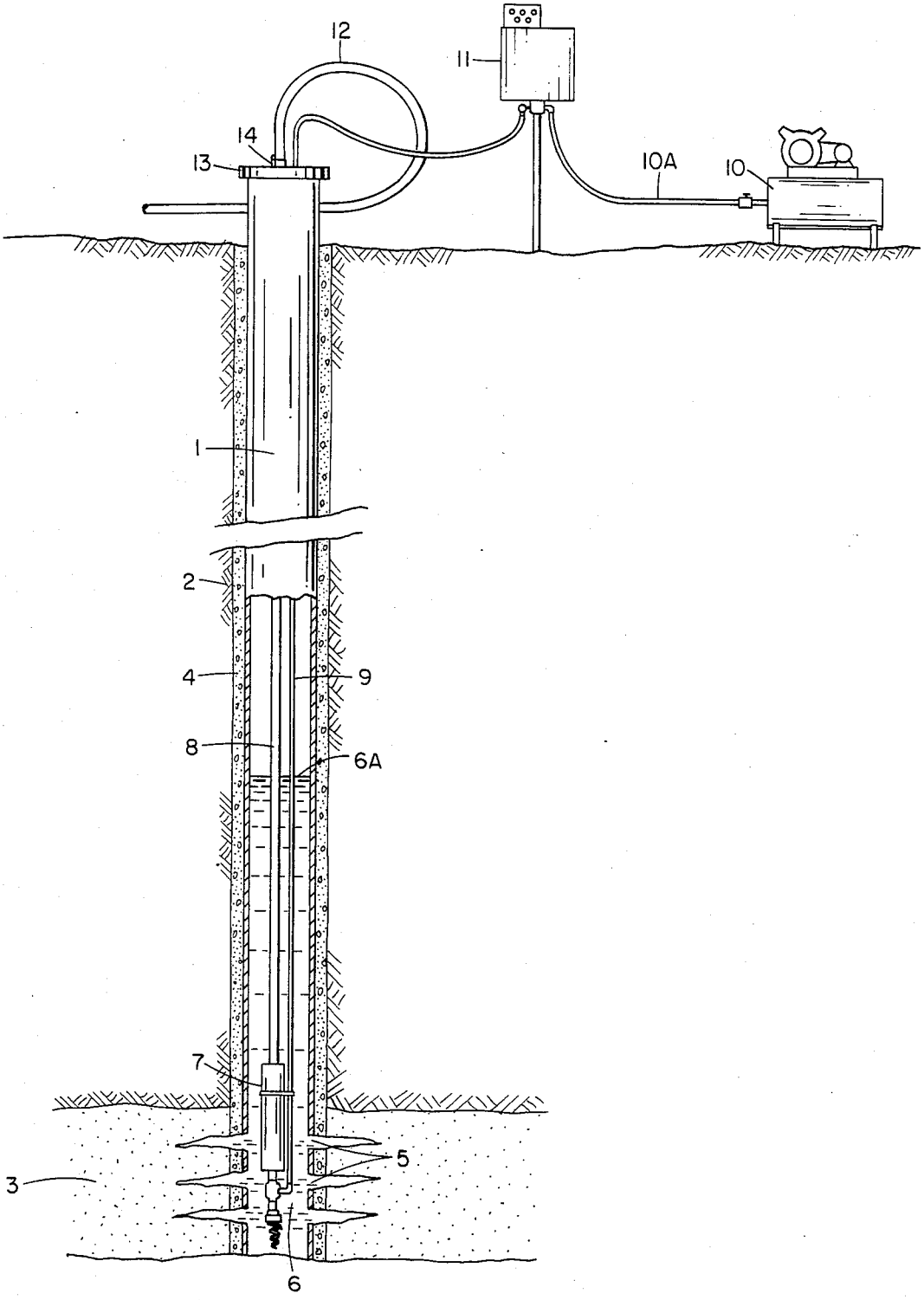
FIG. 1 is a partial vertical section of a typical shallow well illustrating the present invention installed in the well, including all ancillary equipment.
Figure 2:
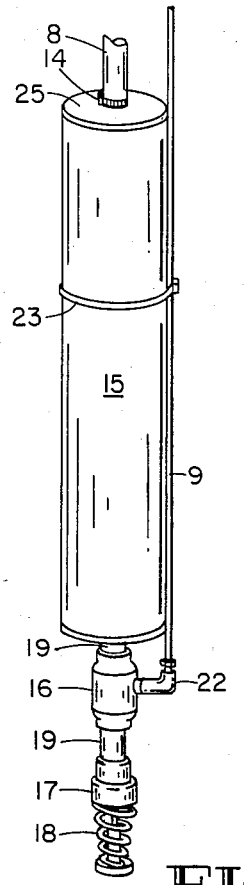
FIG. 2 is an enlarged perspective view of the downhole air lift assembly.
Figure 3:
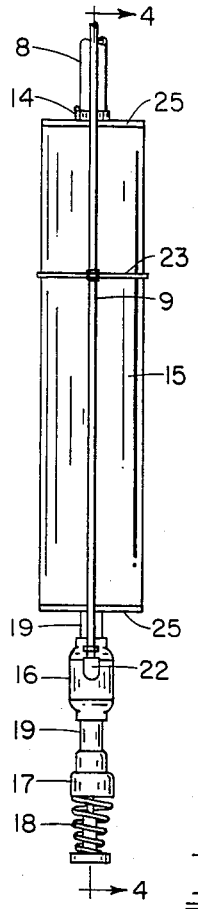
FIG. 3 is a side elevation taken along 3—3 of FIG. 2.

FIG. 1 illustrates a typically completed oil well and general arrangement of the present invention. A well casing 1 extends through a well bore in the earth 2 to the oil bearing formation 3. The casing 1 has been cemented into place with cement 4. Perforations 5 are made in the casing 1 to allow oil fluids 6 to communicate with and flow into the casing 1 from the oil bearing formation 3 for removal. It should be noted the preceeding description of FIG. 1 details a typically completed oil well which in this specification has no significant bearing of the operation of the present invention other than to exhibit the present invention installed in a typically completed well. The present invention is applicable to any variety of well completions which consist of an open casing to the oil formation such as exhibited in FIG. 1. The only feature considered as significant is casing 1 must be of sufficient internal diameter allowing physical insertion of that portion of the present invention as shown in the enlarged perspective view of FIG. 2, the downhole lift assembly, also generally shown in FIG. 1 as 7.

The oil fluids 6 entering the casing 1 will seek some natural fluid level 6A as shown. The present invention is installed with its downhole lift assembly, generally shown as 7 in FIG. 1, submerged in the fluids 6 near or opposite the elevation of the oil bearing formation 3. The downhole lift assembly generally shown as 7 in FIG. 1, is connected to the production tubing 8 and air lift supply line 9. Production tubing 8 supports the lift assembly through well seal 13 by tubing clamp 14. The production tubing 8 and air lift supply line 9 are specified as new and improved lightweight, pressure, chemical, and flow efficient materials. The conventional iron base materials customarily used in oil well completions and production typically reflect the materials which were available to the oil industry. The advent of new technology in piping materials now allows for a greater diversity in production techniques in which various materials can be successfully utilized. This present invention incorporates these technologically advanced materials and in so doing, greatly reduces installation time, expense, and associated workover expenses normally incurred with a standard completion.

Production tubing 8 and air lift supply line 9 are installed in the well from rolls of extruded tubing of sufficient length to reach the desired operating level. Although the material utilized in the present invention should not be confined to the following, for clarity in this descriptive specification, the material will be designated as high molecular density, chemically inhibited, polyethelene tubing.

Utilizing this unique material as production tubing 8 offers several advantages. A primary advantage is that for shallow well installation, the weight of this material is of such a value as to allow the installation of the entire air lift assembly generally shown as 7, production tubing 8, and air lift supply line 9 by hand thereby requiring no expensive workover rig time.

In a similar manner, if remedial work is required to clean a well, the entire system is also retrievable by hand again offering a cost savings.

The consideration of these workover expenses are of paramount concern to the shallow oil operator. This due in part to the general low productivity of these shallow wells versus the high expense of workovers.

This material utilized in the present invention as production tubing 8 and air lift supply line 9 is not only lightweight and strong but is also chemically resistant to the corrosive and oxidizing conditions prevalent in many wells causing serious attack to conventional iron base materials. The extrusion process used in the manufacturing of this tubing also provides additional advantages. First, the manufacturing extrusion process provides a tubing in which the internal walls have an extremely low frictional flow coefficient (Reynolds Number) which in turn greatly increases the efficiency of lifting fluids. Secondly, this same internal characteristic also provides resistance to buildup on the internal surfaces of the tubing of such contaminants as paraffin and scale which also improves lift efficiency. Thirdly, wall wetting and fluid fall back are greatly reduced by the characteristic of this extrusion process.

The flexibility of this tubing also allows the formation of flow loop 12 at the well casing head. This flow loop design dramatically reduces outlet flow losses which are normally incurred when using the standard pipe fittings ells and tees of a typical completion.

FIG. 1 illustrates the lift assembly shown as 7, production tubing 8, and air lift supply line 9 installed in a typically completed well. Airlift supply line 9 is connected to the photovoltaic solar powered control device generally shown as 11 in FIG. 1. The control device is continuously supplied with pressurized air from a pressure regulated air compressor 10 through connecting air supply line 10A providing motive force for the lifting operation.

Figure 4:
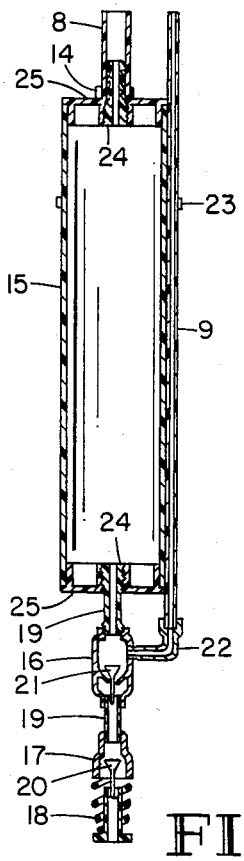
FIG. 4 is a detailed sectional view taken along 4—4 of FIG. 3.
Figure 5:
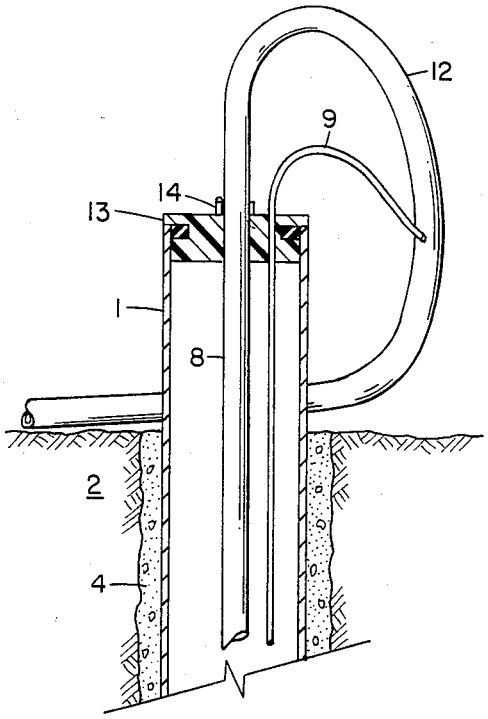
FIG. 5 is an enlarged partial vertical section of the well seal, air lift support assembly, and flow loop at the well casing head.

Using the general well illustration of FIG. 1 and the detailed section of FIG. 4, the present invention operational process can be further described.

The downhole lift assembly generally shown as 7 in FIG. 1 and detailed further in FIG. 4, consists of several parts. Foot check valve 17 with stainless steel strainer 18 and stainless steel poppet 20 is constructed of Navy Brass. This foot check valve 17 is connected by means of a polyvinylchloride pipe nipple 19 in series to Navy Brass lift check valve 16 also with a stainless steel poppet 21. This flow check assembly is then connected to a polyvinylchloride volume expansion chamber 15 having two tapped insert bushings 25 for bottom connection with the lower flow check valve assembly by polyvinylchloride nipple 19 and upper connection with production tubing 8 by polyvinylchloride insert fitting 24 and stainless steel clamp 14. Lift check valve 16 is tapped on the outlet side for the connection of brass inlet nozzle 22 and airlift supply line 9 by an acetal copolymer compression collet.

For convenience in installation, air lift supply line 9 is secured to volume expansion chamber 15 by means of a nylon tiewrap 23 and can be likewise secured along the length of the production tubing 8 as needed. All components of polyethelene, polyvinylchloride, acetal copolymer, nylon, Navy brass, and stainless steel comprising this protion of the present invention are highly resistant to oxidation, corrosion, and chemical attack prevalent in shallow oil well conditions.

With the downhole assembly of the present invention in place, the oil fluids 6 inflowing through perforations 5 into casing 1 have reached some natural level 6A as shown in FIG. 1. In the static or "off" cycle of the process, this level 6A produces a hydrostatic pressure head on the generally shown lift assemby 7 of FIG. 1. Referring to FIG. 4, this pressure head forces open poppet assembly 20 of the lower foot check valve 17 allowing oil fluids 6 to pass through poppet 21 of lift check valve 16 thereby filling volume expansion chamber 15 and production tubing 8 to an equalized level with fluid level 6A. The entering fluids 6 of FIG. 1 are maintained contaminant free by the stainless steel strainer assembly 18 of lower foot check valve 17 in FIG. 4. This filtering process insures a reduction of major particulate which might present pluggage problems of the lower lift check valve poppet assembly 21. If in the event small particulate contaminates inadvertently accumulate under the poppet assembly 21, inlet nozzle 22 has been so positioned that the pressurized injection air will clean away these contaminants. This feature results in a system operation with reduced maintenance problems due to contaminants and the accompanying pump inoperation.

Figure 6:
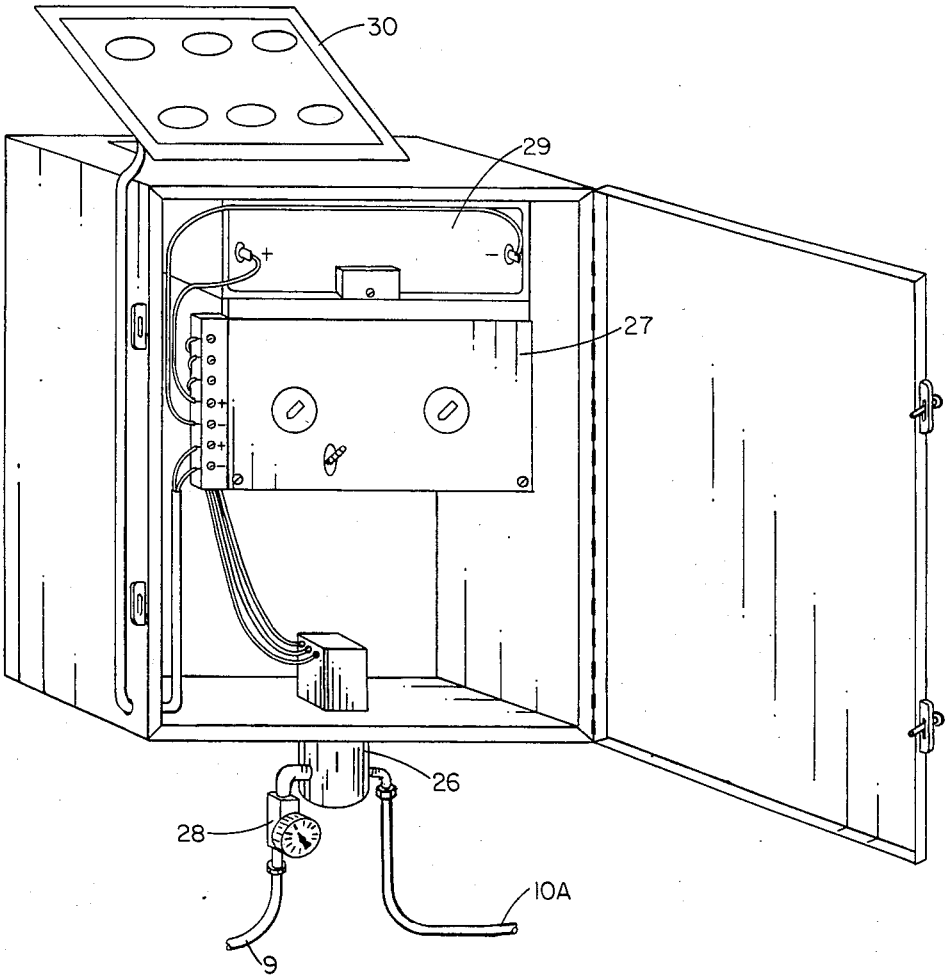
FIG. 6 is a perspective view of the photovoltaic solar powered and programmable control system and associated pulse valve assembly.

With the system equalized and prepared for the "on" lifting cycle of operation, control device, generally shown as 11 in FIG. 1, utilizes logic panel 27 in FIG. 6, to pulse open control valve 26 shown in FIG. 6 allowing pressurized air from air compressor 10 and air supply line 10A shown in FIG. 1, to flow through control valve 26 of FIG. 6, monitoring gage assembly 28, airlift supply line 9, inlet nozzle 22 of FIG. 4 into lift check valve 16.

Pressurization of the fluid column forces poppet 21 closed against its seat and directs the injected air into volume expansion chamber 15. This volume injection of pressurized air results in a kinetic release of energy through expansion which in turn forms a high pressure liquid-air mixing phase in the volume chamber 15 with such phase causing a reduction of the specific gravity of the oil fluids 6 contained therein. This decrease in specific gravity or "lightening" of the fluid 6 and associated pressure results in the lift cycle. The lift cycle then results in the movement of oil fluids 6 from the zone of higher pressure towards the zone of lower pressure and atmosphere at the earth's surface and storage.

After the predetermined "on" cycle time has elapsed, the control valve 26 in FIG. 6 is pulsed off by the programmable logic panel 27 allowing an "off" cycle time during which static conditions exist for the refilling of the downhole lift assembly generally shown as 7 in FIG. 1 in preparation for another lift "on" cycle.

The production cycling rate of "on" time and "off" time can be monitored and appropriate programming of logic panel 27 can be determined by monitoring gage assembly 28 shown in FIG. 6 as follows. The fluid level 6A of FIG. 1 will produce a resultant back pressure head on the lift assembly generally shown as 7 in FIG. 1. This pressure will result in a readout on the pressure gage of assembly 28 when the system is in the static or "off" condition. Monitoring of the resultant fluid level 6A of FIG. 1 during operation and programming of logic panel 27 of FIG. 6 to match desired fluid level conditions will then result in the proper operation of the present invention for an individual well inflow rate.

An additional feature of the present invention is the control device generally shown as 11 in FIG. 1 is a photovoltaic solar energy panel with a self-contained power supply and battery backup unit. The design of the system allows the photovoltaic solar panel 30 of FIG. 6 to charge and maintain an adequate power reserve in battery 29 which will maintain operation of the system during darkness and in the event of overcast conditions, can continuously operate the system for an estimated 30 days through the power reserve provided. This unique design feature eliminates the time, expense, materials, and potential dangers existing with conventional high voltage alternating current power source installations. The advantages of this feature are numerous when considering rodent, moisture, and unauthorized trespass of personnel in a low security field operation.

A significant economic feature of the present invention is the low volume of supply air required to perform a lift cycle. Testing reveals a low flow of 3–5 cubic feet per minute during an "on" cycle of 20–40 seconds will provide adequate lifting of fluids. If a low producing shallow well requires only 15–20 cyclic operations per day, it is easily seen that the initial investment in one compressor of adequate size (say, 20 cfm capacity) can supply many wells in the same field. Typical designs indicate one compressor may be sized to provide lifting motive force for as many as 30 wells or more in the same field operation. This design of the present invention thereby eliminates the major equipment expense such as normally experienced with a jack type pumping system. The capital costs per well are greatly reduced due to this factor.

The foregoing description of the present invention has been directed to a particular preferred embodiment for the purpose of illustration and explanation. It will be apparent, however, to those skilled in this art that modifications and changes or additions to the illustrated system and process taught may be made without departing from the spirit of the invention. It is the applicant's intention in the following claims to cover all equivalent modifications and variations as fall within the scope of the invention.

Having described my invention, I now claim:

1. A system for air lifting oil fluids from an oil producing formation which communicates with a well bore and a casing in said well bore, said system comprising:

an inlet foot check valve and strainer assembly at the lower end of said of said system, said assembly permitting one way inflow and filtering of said oil fluids from said well bore and casing;

an air lift check valve located directly above and in series communication with said assembly, said air lift check valve including a valve housing, a poppet, and a valve seat;

a volume expansion chamber for receiving and holding said oil fluids to be air lifted, said expansion chamber having lower and upper ends, the lower end of said expansion chamber being in direct series communication with said air lift check valve; production tubing extending from a surface location to the upper end of said expansion chamber;

said expansion chamber having a greater diameter than said check valves and said production tubing;

an air lift supply line extending from surface equipment, for supplying pressurized lift air, to an inlet nozzle located in said air lift valve housing at a location above said poppet.

2. A system for lifting said oil fluids as defined in claim 1 wherein said nozzle performing contaminant cleaning of said air lift check valve poppet and seat.

3. A system for lifting said oil fluids as defined in claim 1 wherein said air lift supply line and said production tubing are of flexible lightweight, corrosion resistant, oxidation resistant and high flow efficient materials.

4. A system for lifting said oil fluids as defined in claim 1 wherein said expansion chamber is made of polyvinylchloride; further polyvinylchloride fittings connect said expansion chamber with said air lift valve, and said production tubing.

5. A system for lifting said oil fluids as defined in claim 1 wherein said airlift check valve and inlet foot check valve are comprised of corrosion resistant Navy Brass with stainless steel poppet and seat.

6. A system for lifting said oil fluids as defined in claim 1 whereby pressurized air is injected through said airlift supply line and inlet nozzle utilizing kinetic expansion of pressurized air and decrease of oil fluid specific gravity and hydrostatic fluid level as the lifting principle.

7. A system for lifting said oil fluids as defined in claim 1 whereby inflow of said fluids to said volume expansion chamber is accomplished by hydrostatic recharge.

8. A system for lifting said oil fluids as defined in claim 1 whereby said pressurized lift air is supplied through a self-contained, photovoltaic, solar powered, programmable control device.

9. A system for lifting said oil fluids as defined in claim 8 whereby said control device operates a low energy consumption pulse action valve.

10. A system for lifting said oil fluids as defined in claim 8 whereby said control device is further defined as containing a monitoring gage assembly for determining well production inflow and proper controller rate programming.

11. A system for lifting said oil fluids as defined in claim 8 whereby said control device contains a reserve battery power source with voltage level maintained in a fully charged state by a photovoltaic solar panel.

12. A system for lifting said oil fluids as defined in claim 8 whereby said control device is supplied with motive lift air by a pressure regulated air compressor.

13. A system for lifting said oil fluids as defined in claim 12 whereby said pressure regulated air compressor is capable of supplying multiple well operation due to the efficiency of said lift system and low air consumption rate.

* * * * *